US009798257B2

(12) United States Patent
Croteau et al.

(10) Patent No.: US 9,798,257 B2
(45) Date of Patent: Oct. 24, 2017

(54) SPARGED TONER

(71) Applicant: Xerox Corporation, Norwalk, CT (US)

(72) Inventors: Matthew W Croteau, Rochester, NY (US); Mark A Jackson, Rochester, NY (US); Roger B B Keeble, Woodbridge (CA); Harold R Judd, Toronto (CA); Munir Salman, Burlington (CA); Vincenzo G Marcello, Penfield, NY (US); Chieh-Min Cheng, Rochester, NY (US); Steven M Malachowski, East Rochester, NY (US); Grazyna Kmiecik-Lawrynowicz, Fairport, NY (US); Linda S Schriever, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/958,838

(22) Filed: Dec. 3, 2015

(65) Prior Publication Data

US 2017/0160659 A1 Jun. 8, 2017

(51) Int. Cl.
*G03G 9/08* (2006.01)

(52) U.S. Cl.
CPC ..... *G03G 9/0815* (2013.01); *G03G 9/0804* (2013.01); *G03G 9/0825* (2013.01)

(58) Field of Classification Search
CPC ..... G03G 9/0804
See application file for complete search history.

(56) References Cited

U.S. PATENT DOCUMENTS

2008/0153025 A1* 6/2008 Lai ..... G03G 9/09392 430/109.3

* cited by examiner

*Primary Examiner* — Peter Vajda

(57) ABSTRACT

A method for removing volatile organic compounds (VOC's) from toner slurries is described, including the isolated toner particles generated by that method.

19 Claims, No Drawings

SPARGED TONER

FIELD

A process of removing volatile organic compounds (VOC's) from toners by sparging toner slurries is disclosed, including novel toners produced by said process.

BACKGROUND

Volatile organic compounds (VOC's) in toner are released during fusing and can be detrimental to the environment and to the health of those working in close proximity to a printer. VOC's react with nitrogen oxides in the presence of sunlight to form ozone, a known irritant of the upper respiratory tract. In addition, VOC levels in toner have been linked to machine odor.

Ecolabel certifications, such as, Blue Angel (Germany) and Nordic Swan (Nordic Region), place limits on total volatile organic compounds (TVOC) in toner or limit total VOC emissions from a machine in use. One certification imposes a toner TVOC limit of less than 300 mg/kg.

Odor and VOC emission historically were addressed through reduction of VOC's in the toner or via air filtration systems at point of use. VOC's in a toner arise from the raw materials used to make toner, for example, as impurities in the monomer streams for making latex. Therefore, previous approaches focused on lower VOC raw materials.

However, many raw materials for latex production are commodity materials making identifying low VOC content materials difficult, if not impossible. In addition, suppliers of commodity materials may provide material with higher VOC level when supply assurance issues arise.

Treatment of latex monomer streams is difficult and expensive because the impurities often are chemically similar to the desired component (e.g., isopropyl benzene, the impurity, and styrene, the monomer). Also, the high solid content and chemical properties of latex make removal of VOC's after latex production difficult.

A large portion of toner is for aftermarket sale. There is no control over use of air filtration either as part of a machine or by end users. That makes VOC reduction in toner the only alternative for lowering VOC emissions.

SUMMARY

The instant disclosure provides a device and method using sparging to remove VOC's from toner slurries and the resulting novel toner.

A method for reducing volatile organic compounds (VOC's) from emulsion aggregation (EA) toner particles is disclosed including, aggregating one or more resins in a slurry to a selected growing particle size; optionally forming a shell over the aggregates; freezing aggregate growth by increasing pH of the slurry; ramping temperature of the frozen aggregates, and when the temperature reaches about 70° C., sparging a gas, such as, air, through the slurry; coalescing the toner particles during sparging; stopping sparging and cooling the resulting sparged slurry; and collecting the resulting EA toner particles from the cooled slurry, where the VOC's in the resulting EA toner particles are reduced by at least about 50% as compared to EA toner particles not treated by sparging during coalescence.

In embodiments, a method for reducing volatile organic compounds (VOC's) from emulsion aggregation (EA) toner particles is disclosed, including aggregating one or more resins in a slurry to a target size; freezing aggregate growth by increasing pH of the slurry; ramping temperature of the slurry to between about 92° C. to about 96° C., and when the temperature reaches about 70° C., sparging a gas, such as, air, through the slurry; stopping sparging and cooling the resulting sparged slurry; and collecting and drying the resulting EA toner particles from the cooled slurry, where the VOC's in the resulting dried EA toner particles are less than about 300 ppm.

In embodiments, a device is described comprising a receptacle for conducting coalescence of toner particles, where attached to said coalescence receptacle is a vessel for accepting foam that collects above the slurry in the coalescence receptacle headspace. The foam-collecting vessel comprises one or more anti-foam compound(s). Vapor from the foam-collecting vessel is coursed to a condenser. Optionally, vapor in the coalescence receptacle is coursed to a condenser. Condensate from the one or more condensers can be collected in a one or more storage vessels, which may be a central storage vessel; or each is dedicated to a condenser, or condensate from one or multiple sources can be coursed to the foam-collecting vessel.

In embodiments, toner is provided with a lower level of VOC's and a lower level of surfactant(s). Optionally, melt flow index also can be decreased. VOC's can be reduced by 50% or more and surfactant by 5% or more, from 20% or more as compared to an analogous toner that does not include sparging. Melt flow index can be reduced by 15% or more.

For a better understanding of the subject matter of interest as well as other aspects and further features thereof, reference is made to the following description.

DETAILED DESCRIPTION

The present subject matter offers a device and method for removal of VOC's from toner slurry during coalescence that is cost effective and can achieve sufficient VOC reduction that yields novel toners without compromising final toner quality and function.

A standard emulsion aggregation (EA) process to manufacture toner particle can be composed of the following basic steps:

1. optionally, a homogenization step, in which shear force is used to normalize the size of growth sites before aggregation and to disperse raw materials evenly throughout a slurry;
2. an aggregation step, in which toner particles are grown to a targeted size;
3. optionally, a shell step in which a layer of latex is added to the core particle;
4. a freeze step, in which particle growth is terminated, generally obtained with the slurry pH being increased;
5. a temperature ramp step where the slurry is ramped to a temperature, generally above 90° C.;
6. a coalescence step where the slurry is held at a constant elevated temperature to contour particle shape;
7. a cooling step where the slurry is cooled to stop coalescence; and
8. optionally, a final pH adjustment step to yield toner particles.

In embodiments, the toner slurry is sparged during ramp and coalescence to take advantage of the elevated temperature. The vapor pressure(s) of individual VOC component(s) will be highest at those process stages, driving partitioning of the VOC's to the vapor phase.

The process of interest has the following modifications as compared to a standard set up for making EA toner. A device is fitted to or with a reactor to enable introduction of a gas, such as, air, into the reactor, such as, one or more inlet ports, an orifice plate or similar device with one or more holes or access ports, openings, passages, voids and the like to permit passage and entry of a gas, such as, air, into the reactor and so on. The device for introducing gas, such as, air, into the reactor can be situated at a lower or bottom portion of the reactor, such as, the bottom of the reactor or from the interior perimeter of the reactor near the bottom of the reactor, and is(are) connected to gas line or conduit which is in fluid communication with a gas source to enable entry of a gas stream or gas streams into the reactor and hence, into the slurry.

The reactor can include one or more access ports at or near the top of the reactor to allow one or more lines to enable removal of foam and optionally vapor from the reactor. One access point is connected to a line, conduit and the like that courses foam from the reactor to an overflow foam collecting or receiving tank or vessel which contains an antifoam compound or reagent, such as, a silicone antifoam (Bluestar Silicones, NJ; New London Chemicals, FL; and Dow Corning, MI). Antifoam E-20 (Kao USA, OH) and so on, such as, for example, polydimethylsiloxane (PDMS).

The amount of anti-foam compound in the collection tank is a design choice and can be based on manufacturer recommendations. Additional anti-foam compound can be introduced into the foam receiving tank as needed. The contents of the foam collecting vessel can be removed periodically or as needed.

An optional second access port near or at the top of the reactor is connected to a condenser and is used to collect vapor above the slurry surface in and/or from the reactor headspace. Vapor is exposed to reduced temperature in a condenser to enable condensation of the gaseous compound(s) in the vapor phase. The condensate is coursed to a storage vessel or to the foam collecting tank.

Vapor also can be transported from the reactor to the foam collecting tank by the conduit for transporting foam from the reactor.

Vapor collecting or in the foam receiving vessel can be transported from the foam collecting tank and coursed to a condenser and condensate therefrom is coursed to a storage vessel or returned to the foam collecting or treatment tank.

One or more urging devices, such as, a pump, impeller and so on, can be placed at different sites along the foam and vapor paths to provide additional control and movement of the fluid, foam and gas streams in the conduits, tubes and so on.

In embodiments, the process as disclosed follows a standard EA process up to the freeze step. Freeze pH can influence coalescence time to attain a target shape. For example, a freeze pH of 5.1 results in coalescence times of, on average, about 1.5 hours. That may be an insufficient time to remove the desired amount of VOC's from the slurry. Therefore, freeze pH can be varied to ensure sufficient coalescence time so that the requisite amount of VOC's are removed, without negatively impacting particle morphology and properties. Increased temperature allows for greater efficiency of VOC removal. In the standard process, no purge gas is passed through the slurry during ramp up and coalescence and all vapors that escape the slurry condense and return to the reactor. In the instant process, sparging gas, such as, air, ensues that when the reactor reaches about 70° C., vapor and foam are removed from the reactor in a unidirectional path to a foam collection device, thereby removing VOC's and surfactants from the toner particle slurry.

In embodiments, sparging gas flow is at a higher flow rate and can be at least about 14 standard cubic feet per minute (SCFM), format least about 15 SCFM, format least about 16 SCFM, at least about 16 SCFM, at least about 17 SCFM, at least about 19 SCFM, at least about 21 SCFM, although the actual gas flow rate can be outside of those ranges provided toner particle function is not impacted negatively and adequate VOC's are removed.

Total sparge time can vary, again, based on toner properties, VOC removal, slurry temperature, slurry solids content, slurry viscosity, VOC's present, coalescence time and so on. Hence, sparge time can be at least about 1 hour, at least about 2 hours, at least about 3 hours, at least about 4 hours or more, between about 1 hour and about 7 hours, between about 2 hours and about 7 hours, between about 3 hours and about 7 hours, between about 4 hours and about 7 hours, between about 1 hour and about 6 hours, between about 2 hours and about 6 hours, between about 3 hours and about 6 hours, but may be outside of those ranges as removal of VOC's to a desired level is determinative without a negative impact on toner function.

Due to common presence of surfactant(s) in the slurry, gas sparging may lead to varying amounts of foaming and the reactor headspace may be filled therewith. To prevent foam from reaching any condenser vent and/or exhaust vent and any other egress point from the reactor on or at the roof of the reactor and to capture foam and vapor, at least one separate tank filled with an anti-foam agent is included with the reactor and foam is funneled to that separate foam-containing (foam colleting, foam receiving and the like are synonyms) receptacle (vessel, container, tank and the like are synonyms). An outlet vent from the foam tank can be present and is connected to a condenser to enable any vapor released from the foam to course to the condenser and any condensate from the condenser can be funneled to a storage container or can be returned to the foam-containing receptacle.

The amount of VOC or VOC's remaining in the toner particle can be less than about 350 parts per million (ppm), less than about 325 ppm, less than about 300 ppm, less than about 275 ppm or lower. When compared to an analogous toner made with the same materials and methods aside from using sparging during ramp and coalescence, VOC content can be reduced at least about 40%, at least about 45%, at least about 50%, at least about 55%, at least about 60%, at least about 65%, at least about 70% or more.

The amount of surfactant or surfactants remaining in the toner particle is reduced. The amount of surfactant removed can depend on the surfactant, amount of surfactant in the slurry, on toner components, such as, colorant, and so on. The amount of surfactant removed can be at least about 5% (relative to the amount of surfactant present in a control, analogous toner made with the same materials and method but not produced with sparging during coalescence), at least about 7.5%, at least about 10%, at least about 12.5%, at least about 15%, at least about 17.5%, at least about 20%, at least about 25%, at least about 30%, at least about 35% or more.

When compared to an analogous toner made with the same materials and methods aside from using sparging during ramp and coalescence, MFI may be reduced at least about 15%, at least about 17%, at least about 19%, at least about 21%, at least about 23%, at least about 25% or more. A lower MFI can be useful in low temperature toner that fuses at lower temperatures.

Unless otherwise indicated, all numbers expressing or relating to quantities and conditions, and so forth used in the specification and claims are to be understood as being modified in all instances by the term, "about." "About," is meant to indicate a variation of no more than 10% from the stated value. Also used herein is the term, "equivalent," "similar," "essentially," "substantially," "approximating," and "matching," or grammatic variations thereof, have generally acceptable definitions or at the least, are understood to have the same meaning as, "about." Hence, substantially unchanged or substantially the same are meant to indicate that the values of the two samples are the same or vary by no more than 10%, no more than 7.5%, no more than 5%.

As used herein, "standard cubic feet per minute" means the volumetric flow rate of a gas corrected to "standardized" conditions of temperature and pressure.

As used herein, "analogous," means a method or product that contains the same ingredients and/or is made by the same method aside from at least one factor, such as, replacing one reagent for another or including a new or modifying an existing process step. For example, two analogous toner of interest can contain the same ingredients and be made by the same EA process except that one toner is made by a process that includes sparging at ramp and coalescence and the analogous other toner is made by the same EA process but without any sparging during ramp and coalescence.

As used herein, "sparging," refers to a technique which involves bubbling a gas, such as, nitrogen or air, through a liquid. In embodiments, the gas can be heated to a temperature similar to that of the slurry in the reactor. The gas can be heated only to the temperature when sparging ensues.

As used herein, "melt flow index," refers to the mass of polymer, in grams, flowing in ten minutes through a capillary of a specific diameter and length by a pressure applied via prescribed alternative gravimetric weights for alternative prescribed temperatures. Devices for such measurement may include a melt indexer extrusion plastometer from Tinius Olsen (Horsham, Pa.).

As used herein, VOC's include, but are not limited to, low molecular weight organic compounds, for example, in the range of about 50 $gmol^{-1}$ to about 250 $gmol^{-1}$. In embodiments, such low molecular weight organic compounds may have boiling points in the range of about 70° C. to less than about 110° C. However, VOC's are not to be so limited, although practically, VOC's with lower boiling points, such as, less than about 130° C., less than about 120° C., less than about 110° C., less than about 100° C. or lower are those of interest as those VOC's are among those that can be removed during a coalescence process. Thus, VOC's with a boiling point less than the maximum coalescence temperature would be of interest as those that can be removed in the practice of the subject matter of interest.

Among the VOC's that may be removed by the process of interest include, but are not limited to, N,N-dimethylnitrosamine; chloroethane; benzoic acid; EDTA; benzene; benzaldehyde; cytosine; acrolein; isopropylbenzene; n-propylbenzene; styrene; n-butyl ether; n-butyl propionate; methylene chloride; acrylonitrile; 1,1-dichloroethane; 1,1,1-trichloroethane; chloroform; 1,2-trans-dichloroethylene; 1,2-dichloroethane; diphenylamine; benzothiazole; 1,4-dichlorobenzene; p-chloro-m-cresol; 1,2-dichlorobenzene; naphthalene; 1,1-diphenylhydrazine; p-nitroaniline; 4-bromophenyl phenyl ether; 2,6-dinitrotoluene; pentachlorophenol; 2-naphthylamine; 2-chloroethyl vinyl ether; dibromochloromethane; 1,1-dichloroethylene; 5-fluorouracil; trichlorofluoromethane; 1,1,2-trichloroethane; 1,2-dichloropropane; cyclohexanone; dichlorobromomethane; 1,2-dichloropropene; 1,1,2,2-tetrachloroethane; benzo[ghi]perylene; uracil; bis (2-chloroethoxy)methane; carbon tetrachloride; bromoform; phenol; bis(2-chloroisopropyl) ether; N-nitroso di-n-propylamine; 5-chlorouracil; toluene; thymine; trichloroethylene; isophorone; 2,4-dinitrophenol; benzo[a]pyrene; 5-bromouracil; o-anisidine; tetrachloroethylene; 2-chlorophenol; ethylbenzene; 1,2-dibromo-3-chloropropane; 3,4-benzofluoroanthrene; nitrobenzene; dibenzo [a,h]anthracene; adenine; 1,2,3,4-tetrahydronaphthalene; acetophenone; 4-nitrophenol; 2,4-dimethylphenol xylenes; chlorobenzene; hexachloroethane; dimethylphthalate and the like.

While the subject matter has been described with reference to electrophotographic printing processes, it will be understood that the method and materials have applications in other areas and industries where, fluids, or any process where a reduction in the release of VOC's from the fluids may be desired. In the imaging arts, fluids treated by the method of interest and the resulting treated fluids and product can be used in downstream processes, such as, the production of a toner, as known in the art.

Resins

The toners disclosed herein can be prepared from any desired or suitable resins suitable for use in forming a toner. Such resins, in turn, can be made of any suitable monomer or monomers. Suitable monomers useful in forming the resin include, but are not limited to, styrenes, acrylates, methacrylates, butadienes, isoprenes, acrylic acids, methacrylic acids, acrylonitriles, esters, diols, diacids, diamines, diesters, diisocyanates, mixtures thereof and the like.

Examples of suitable polyester resins include, but are not limited to, sulfonated, non-sulfonated, crystalline, amorphous, combinations thereof and the like. The polyester resins can be linear, branched, combinations thereof and the like. Polyester resins can include those resins disclosed in U.S. Pat. Nos. 6,593,049 and 6,756,176, the entire disclosure of each of which is incorporated herein by reference. Suitable resins also include mixtures of amorphous polyester resins and crystalline polyester resins as disclosed in U.S. Pat. No. 6,830,860, the entire disclosure of which is incorporated herein by reference.

Other examples of suitable polyesters include those formed by reacting a polyol with a polyacid (or polyester) in the presence of an optional catalyst. For forming a crystalline polyester, suitable polyols include, but are not limited to, aliphatic polyols with from about 2 to about 36 carbon atoms, such as, 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof and the like.

The aliphatic polyol can be selected in any desired or effective amount, in embodiments, at least about 40 mole percent, in embodiments, at least about 42 mole percent, in embodiments, at least about 45 mole percent, although the amount can be outside of these ranges.

Examples of suitable polyacids (or polyesters) for preparation of crystalline resins include, but are not limited to, oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a polyester or anhydride thereof and the like, as well as combinations thereof.

The polyacid can be selected in any desired or effective amount, in embodiments, at least about 40 mole percent, in embodiments, at least about 42 mole percent, in embodiments, at least about 45 mole percent, although the amount can be outside of these ranges.

Examples of suitable crystalline resins include, but are not limited to, polyesters, polyamides, polyimides, polyolefins, polyethylene, polybutylene, polyisobutyrate, ethylene-propylene copolymers, ethylene-vinyl acetate copolymers, polypropylene, and the like, as well as mixtures thereof. Specific crystalline resins can be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly (pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly (ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and the like, as well as mixtures thereof.

The crystalline resin can be present in any desired or effective amount, in embodiments, at least about 5 percent by weight of the toner components, in embodiments, at least about 10 percent by weight of the toner components, in embodiments, no more than about 50 percent by weight of the toner components, in embodiments, no more than about 35 percent by weight of the toner components, although the amount can be outside of these ranges.

The crystalline resin can possess any desired or effective melting point, in embodiments, at least about 30° C., in embodiments, at least about 50° C., in embodiments, no more than about 120° C., in embodiments, no more than about 90° C., although the melting point can be outside of those ranges. The crystalline resin can have any desired or effective number average molecular weight ($M_n$), as measured by gel permeation chromatography (GPC), in embodiments, at least about 1,000, in embodiments, at least about 2,000, in embodiments, no more than about 50,000, in embodiments, no more than about 25,000, although the $M_n$ can be outside of those ranges, and any desired or effective weight average molecular weight ($M_w$), in embodiments, at least about 2,000, in embodiments, at least about 3,000, in embodiments, no more than about 100,000, in embodiments, no more than about 80,000, although the $M_w$ can be outside of those ranges, as determined by GPC using, for example, polystyrene standards. The molecular weight distribution ($M_w/M_n$) of the crystalline resin can be of any desired or effective number, in embodiments, at least about 2, in embodiments, at least about 3, in embodiments, no more than about 6, in embodiments no more than about 4, although the molecular weight distribution can be outside of those ranges.

Examples of suitable polyacid (or polyester) for preparation of amorphous polyesters include, but are not limited to, polycarboxylic acids, anhydrides, or polyesters, such as, terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate and the like, as well as mixtures thereof. The polyacid (or polyester) can be present in any desired or effective amount, in embodiments, at least about 40 mole percent, in embodiments, at least about 42 mole percent, in embodiments, at least about 45 mole percent, although the amount can be outside of those ranges.

Examples of suitable polyols for generating amorphous polyesters include, but are not limited to, 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene glycol and the like, as well as mixtures thereof. The polyol can be present in any desired or effective amount, in embodiments, at least about 40 mole percent, in embodiments, at least about 42 mole percent, in embodiments, at least about 45 mole percent, although the amount can be outside of those ranges.

Polycondensation catalysts which can be used for preparation of either the crystalline or the amorphous polyesters include, but are not limited to, tetraalkyl titanates, such as, titanium (iv) butoxide or titanium (iv) isopropoxide, dialkyltin oxides, such as, dibutyltin oxide, tetraalkyltins, such as, dibutyltin dilaurate, dialkyltin oxide hydroxides, such as, butyltin oxide hydroxide, aluminum alkoxides, alkyl zinc, dialkyl zinc, zinc oxide, stannous oxide and the like, as well as mixtures thereof. Such catalysts can be used in any desired or effective amount, in embodiments, at least about 0.001 mole percent, in embodiments, no more than about 5 mole percent based on the starting polyacid (or polyester) used to generate the polyester resin, although the amount can be outside of those ranges.

Examples of suitable amorphous resins include polyesters, polyamides, polyimides, polyolefins, polyethylenes, polybutylenes, polyisobutyrates, polyacrylates, polystyrenes, ethylene-propylene copolymers, ethylene-vinyl acetate copolymers, polypropylene and the like, as well as mixtures thereof. Specific examples of amorphous resins which can be used include, but are not limited to, poly (styrene-acrylate) resins, crosslinked, for example, from about 10 percent to about 70 percent, poly(styrene-acrylate) resins, poly(styrene-methacrylate) resins, crosslinked poly (styrene-methacrylate) resins, poly(styrene-butadiene) resins, crosslinked poly(styrene-butadiene) resins, as well as mixtures thereof.

Unsaturated polyester resins also can be used. Examples include those disclosed in U.S. Pat. No. 6,063,827, the entire disclosure of which is incorporated herein by reference. Exemplary unsaturated polyester resins include, but are not limited to, poly(1,2-propylene fumarate), poly(1,2-propylene maleate), poly(1,2-propylene itaconate) and the like, as well as mixtures thereof.

Suitable crystalline resins also include those disclosed in U.S. Pat. No. 7,329,476, the entire disclosure of which is incorporated herein by reference. One specific suitable crystalline resin comprises ethylene glycol and a mixture of dodecanedioic acid and fumaric acid co-monomers with the following formula:

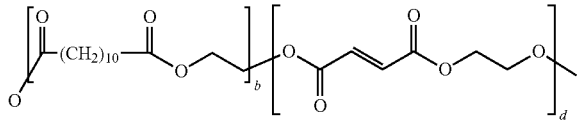

wherein b is from about 5 to about 2000 and d is from about 5 to about 2000, although the values of b and d can be outside of those ranges. Another suitable crystalline resin is of the formula

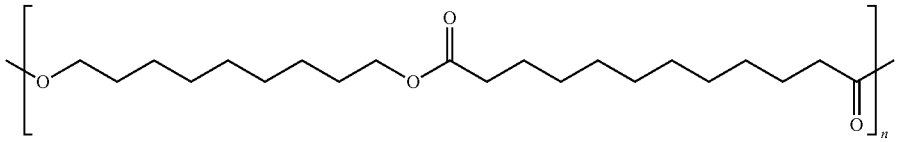

wherein n represents the number of repeat monomer units.

Examples of other suitable latex resins or polymers which can be used include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid) and the like, as well as mixtures thereof. The polymers can be block, random or alternating copolymers, as well as combinations thereof.

Emulsification

The emulsion to prepare emulsion aggregation particles can be prepared by any desired or effective method, such as, a solventless emulsification method or phase inversion process as disclosed in, for example, U.S. Publ. Nos. 2007/0141494 and 2009/0208864, the entire disclosure of each of which is incorporated herein by reference. As disclosed in U.S. Publ. No. 2007/0141494, the process includes forming an emulsion comprising a dispersed phase including a first aqueous composition and a continuous phase including molten one or more ingredients of a toner composition; performing a phase inversion to create a phase inversed emulsion comprising a dispersed phase including toner-sized droplets comprising the molten one or more ingredients of the toner composition and a continuous phase including a second aqueous composition; and solidifying the toner-sized droplets to result in toner particles. As disclosed in U.S. Publ. No. 2009/0208864, the process can include melt mixing a resin in the absence of an organic solvent, optionally adding a surfactant to the resin, optionally adding one or more additional ingredients of a toner composition to the resin, adding to the resin a basic agent and water, performing a phase inversion to create a phase inversed emulsion including a dispersed phase comprising toner-sized droplets including the molten resin and the optional ingredients of the toner composition, and solidifying the toner-sized droplets to result in toner particles.

Also suitable for preparing the emulsion is the solvent flash method, as disclosed in, for example, U.S. Pat. No. 7,029,817, the entire disclosure of which is incorporated herein by reference. As disclosed therein, the process includes dissolving the resin in a water miscible organic solvent, mixing with hot water, and thereafter removing the organic solvent from the mixture by flash methods, thereby forming an emulsion of the resin in water. The solvent can be removed by distillation and recycled for future emulsifications.

Any other emulsification process can be used.

Toner

The toner particles can be prepared by any desired or effective method. Although embodiments relating to toner particle production are described below with respect to emulsion-aggregation processes, any suitable method of preparing toner particles may be used, including chemical processes, such as, suspension and encapsulation processes disclosed in U.S. Pat. Nos. 5,290,654 and 5,302,486, the entire disclosure of each of which is incorporated herein by reference. Toner compositions and toner particles can be prepared by aggregation and coalescence processes in which smaller-sized resin particles are aggregated to the appropriate toner particle size and then coalesced to achieve the final toner particle shape and morphology.

Toner compositions can be prepared by emulsion-aggregation processes that include aggregating a mixture of an optional colorant, an optional wax, any other desired or required additives, and emulsions including the selected resins described above, optionally, in surfactants, and then coalescing the aggregated particle mixture. A mixture can be prepared by adding an optional colorant and optionally a wax or other materials, which also can be, optionally, in a dispersion(s) including a surfactant, to the emulsion, which also can be a mixture of two or more emulsions containing the resin.

Surfactants

Examples of nonionic surfactants include polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether and dialkylphenoxy poly(ethyleneoxy)ethanols, available from Rhone-Poulenc as IGEPAL CA-210™ IGEPAL CA-520™, IGEPAL CA-720™, IGEPAL CO-890™, IGEPAL CO-720™, IGEPAL CO-290™, IGEPAL CA-210™, ANTAROX 890™ and ANTAROX897™. Other examples of nonionic surfactants include a block copolymer of polyethylene oxide and polypropylene oxide, including those commercially available as SYNPERONIC PE/F, such as SYNPERONIC PE/F 108.

Anionic surfactants include sulfates and sulfonates, sodium dodecylsulfate (SDS), Na-dodecylbenene sulfonate, Na-dodecylnaphthalene sulfate, dialkyl benzenealkyl sulfates and sulfonates, acids such as abitic acid available from Aldrich, NEOGEN R™ and NEOGEN SC™ available from Daiichi Kogyo Seiyaku, combinations thereof and the like. Other suitable anionic surfactants include DOWFAX™ 2A1, an alkyldiphenyloxide disulfonate from Dow Chemical Company, and/or TAYCA POWER BN2060 from Tayca Corporation (Japan), which are branched sodium dodecyl benzene sulfonates. Combinations of those surfactants and any of the foregoing nonionic surfactants can be used.

Examples of cationic surfactants, which usually are charged positively, include alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide. $C_{12}$,$C_{15}$, $C_{17}$-trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals and the like, as well as mixtures thereof.

The amount of surfactant in a reagent dispersion or the toner forming emulsion is a design choice or practicing the recommendation of the manufacturer, and can be in the lowest amount necessary to ensure a homogeneous dispersion, emulsion, suspension and the like are attained.

Wax

Optionally, a wax also can be combined with the resin and other toner components in forming toner particles. When included, the wax can be present in any desired or effective amount, in embodiments, at least about 1% by weight, in embodiments, at least about 5% by weight, in embodiments, no more than about 25% by weight, in embodiments, no more than about 20% by weight, although the amount can be outside of those ranges.

Examples of suitable waxes include (but are not limited to) those having, for example, a weight average molecular weight of, in embodiments, at least about 500, in embodiments, at least about 1,000, in embodiments, no more than about 20,000, in embodiments, no more than about 10,000, although the weight average molecular weight can be outside of those ranges.

Examples of suitable waxes include, but are not limited to, polyolefins, such as, polyethylene, polypropylene and polybutene waxes, including those commercially available from Allied Chemical and Petrolite Corporation, for example, POLYWAX™ polyethylene waxes from Baker Petrolite, wax emulsions from Michaelman, Inc. and Daniels Products Company, EPOLENE N-15™ from Eastman Chemical Products, Inc. and VISCOL 550-P™, a low weight average molecular weight polypropylene available from Sanyo Kasei K. K., and the like; plant-based waxes, such as, carnauba wax, rice wax, candelilla wax, sumacs wax, jojoba oil and the like; animal-based waxes, such as, beeswax and the like; mineral-based waxes and petroleum-based waxes, such as, montan wax, ozokerite, ceresin, paraffin wax, microcrystalline wax, Fischer-Tropsch wax and the like; ester waxes obtained from higher fatty acids and higher alcohols, such as, stearyl stearate, behenyl behenate and the like; ester waxes obtained from higher fatty acid and monovalent or multivalent lower alcohols, such as, butyl stearate, propyl oleate, glyceride monostearate, glyceride distearate, pentaerythritol tetrabehenate and the like; ester waxes obtained from higher fatty acids and multivalent alcohol multimers, such as, diethyleneglycol monostearate, dipropyleneglycol distearate, diglyceryl distearate, triglyceryl tetrastearate and the like; sorbitan higher fatty acid ester waxes, such as, sorbitan monostearate and the like; and cholesterol higher fatty acid ester waxes, such as, cholesteryl stearate and the like; and the like, as well as mixtures thereof. Examples of suitable functionalized waxes include, but are not limited to, amines, amides, for example, AQUA SUPERSLIP 6550™ and SUPERSLIP6530™ available from Micro Powder Inc., fluorinated waxes, for example, POLYFLUO 190™, POLYFLUO 200™, POLYSILK 19™ and POLYSILK 14™ available from Micro Powder Inc., mixed fluorinated amide waxes, for example, MICROSPERSION 19™ available from Micro Powder Inc., imides, esters, quaternary amines, carboxylic acids or acrylic polymer emulsions, for example, JONCRYL 74™, 89™, 130™, 537™ and 538™, all available from SC Johnson Wax, chlorinated polypropylenes and polyethylenes available from Allied Chemical and Petrolite Corporation and SC Johnson wax, and the like, as well as mixtures thereof. Mixtures and combinations of the foregoing waxes can also be used. When included, the wax can be present in at least about 1 percent by weight, in embodiments, at least about 5 percent by weight, in embodiments, no more than about 25 percent by weight, in embodiments, no more than about 20 percent by weight, although the amount can be outside of those ranges.

Colorants

Examples of suitable colorants include pigments, dyes, mixtures thereof and the like. Specific examples include, but are not limited to, carbon black; magnetite; HELIOGEN BLUE L6900, D6840, D7080, D7020, PYLAM OIL BLUE, PYLAM OIL YELLOW, and PIGMENT BLUE 1, available from Paul Uhlich and Company, Inc.; PIGMENT VIOLET 1, PIGMENT RED 48, LEMON CHROME YELLOW DCC 1026, E.D. TOLUIDINE RED, and BON RED C, available from Dominion Color Corporation, Ltd., Toronto, Ontario; NOVAPERM YELLOW FGL and HOSTAPERM PINK E, available from Hoechst; CINQUASIA MAGENTA, available from E.I. DuPont de Nemours and Company; 2,9-dimethyl-substituted quinacridone and anthraquinone dye identified in the Color Index as CI-60710, CI Dispersed Red 15, diazo dye identified in the Color Index as CI-26050, CI Solvent Red 19, copper tetra(octadecyl sulfonamido) phthalocyanine, x-copper phthalocyanine pigment listed in the Color Index as CI-74160, CI Pigment Blue, Anthrathrene Blue identified in the Color Index as CI-69810, Special Blue X-2137, diarylide yellow 3,3-dichlorobenzidene acetoacetanilides, a monoazo pigment identified in the Color Index as CI-12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180, Permanent Yellow FGL; Neopen Yellow 075, Neopen Yellow 159, Neopen Orange 252, Neopen Red 336, Neopen Red 335, Neopen Red 366, Neopen Blue 808, Neopen Black X53, Neopen Black X55; Pigment Blue 15:3 having a Color Index Constitution Number of 74160, Magenta Pigment Red 81:3 having a Color Index Constitution Number of 45160:3, Yellow 17 having a Color Index Constitution Number of 21105; Pigment Red 122 (2,9-dimethylquinacridone), Pigment Red 185, Pigment Red 192, Pigment Red 202, Pigment Red 206, Pigment Red 235, Pigment Red 269, combinations thereof and the like.

The colorant is present in the toner in any desired or effective amount, in embodiments, at least about 1% by weight of the toner, in embodiments, at least about 2% by weight of the toner, in embodiments, no more than about 25% by weight of the toner, in embodiments, no more than about 15% by weight of the toner, although the amount can be outside of those ranges. A toner can lack any colorant and be clear.

Examples of suitable conductive pigments include carbon black, including REGAL 330™ (Cabot), Carbon Black 5250 and 5750 (Columbian Chemicals), Sunsperse Carbon Black LHD 9303 (Sun Chemicals) and NIPEX-35 (CAS 1333-86-4) carbon black, available from Degussa; magnetite, including Mobay magnetites MO8029™ and MO8060™, Columbian magnetites MAPICO BLACK™ and surface-treated magnetites, Pfizer magnetites CB4799™, CB5300™, CB5600® and MCX6369™, Bayer magnetites BAYFERROX 8600™ and 8610™, Laxness Bayoxide® E 8706, 8708, 8709, 8710, Bayoxide® E 8707 H and 8713, Northern Pigments magnetites NP-604™ and NP608™, Magnox magnetites TMB-100™ and TMB-104™, NANOGAP magnetites, including NGAP NP FeO-2201, NGAP NP FeO-2202, NGAP NP FeO-2204, NGAP NP FeO-2205-AB, NGAP NP FeO-2206 and NGAP NP FeO-2207, and the like, metallic pigments, including silver and gold sub-micron or nanoparticles, such as, NANOGAP nanoparticle silver NGAP NP Ag-2103, NGAP NP Ag-2104-W, NGAP NP Ag-2106-W and NGAP NP Ag-2111, conductive pigments, such as, $CoAlO_4$ from nGimat™ Co. of Atlanta, Ga., $CoAl_2O_4$, Au, $TiO_2$, $CrO_2$, $SbO_2$, and $CoFe_2O_4$ nanopigments as described by Cavalcantea et al. in, "Dyes and Pigments," Vol. 80, Iss. 2, February 2009, pp. 226-232, the entire disclosure of which is incorporated herein by reference, and conductive dyes, such as, rhodamine dyes, or pigments that contain or can leach a conductive dye component, such as, PR 81.2 rhodamine pigment and the like, as well as mixtures thereof.

Toner Preparation

The pH of the emulsion can be adjusted by an acid, such as, acetic acid, nitric acid or the like. In embodiments, the pH of the mixture can be adjusted to from about 2 to about 4.5, although the pH can be outside of that range. Additionally, if desired, the mixture can be homogenized, by mixing at from about 600 to about 4,000 revolutions per minute (rpm), although the speed of mixing can be outside of that range. Homogenization can be performed by any desired or effective method, for example, with an IKA ULTRA TURRAX T50 probe homogenizer.

Following preparation of the above mixture, an aggregating agent can be added to the mixture. Any desired or effective aggregating agent can be used to form a toner. Suitable aggregating agents include, but are not limited to, aqueous solutions of divalent cations or a multivalent cations. Specific examples of aggregating agents include polyaluminum halides, such as, polyaluminum chloride (PAC), or the corresponding bromide, fluoride or iodide, polyaluminum silicates, such as, polyaluminum sulfosilicate (PASS), and water soluble metal salts, including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and the like, as well as mixtures thereof. In embodiments, the aggregating agent can be added to the mixture at a temperature below the glass transition temperature ($T_g$) of the resin(s).

The aggregating agent can be added to the mixture used to form a toner in any desired or effective amount, in embodiments, at least about 0.1 percent by weight, in embodiments, at least about 0.2 percent by weight, in embodiments, at least about 0.5 percent by weight, in embodiments, no more than about 8 percent by weight, in embodiments, no more than about 5 percent weight of the resin in the mixture, although the amount can be outside of those ranges.

To control aggregation of the particles, the aggregating agent can be metered into the mixture, for example, over a period of, in embodiments, at least about 5 min, in embodiments, at least about 30 min, in embodiments, no more than about 240 min, in embodiments, no more than about 200 min, although more or less time can be used. Addition of the agent also can be performed while the mixture is stirred, in embodiments, at least about 50 rpm, in embodiments, at least about 100 rpm, in embodiments, no more than about 1,000 rpm, in embodiments, no more than about 500 rpm, although the mixing speed can be outside of those ranges, and, in embodiments, at a temperature that is below the $T_g$ of the resin(s) as discussed above, in embodiments, at least about 30° C. in embodiments, at least about 35° C., in embodiments, no more than about 90° C., in embodiments, no more than about 70° C., although the temperature can be outside of those ranges.

In embodiments, the process as disclosed follows a standard EA process up through the freeze step. In an aspect, the slurry pH is increased using, for example, a 4% NaOH solution, to a pH of about 5 to freeze aggregation. Freeze pH can influence coalescence time, for example, a freeze pH of about 5 results in coalescence times of only about 1.5 hours, on average. That may be insufficient time to remove the desired amount of VOC's from the slurry. Therefore, for example, in a TVOC removal process of interest, the freeze pH and base amount can be set to achieve about a 4 hour coalescence. After freezing, the slurry then is ramped, for example, to about 92° C. or to about 96° C. for coalescence. In embodiments, the increased temperature in the process and the extended coalescence time as disclosed herein allow for greater efficiency of VOC removal. In standard processes, no purge or sparge gas is passed through the slurry during coalescence and all vapors that come off the slurry are condensed and returned to the reactor. In the instant process, sparging, gas, such as, air, is introduced to the reactor when the slurry reaches about 70° C. (based, in part, on the boiling point(s) or the organic reagent(s) in the slurry) during the temperature ramp to coalescence and vapors are removed and condensed, and the condensate passed to a storage vessel separate from the reactor.

For example, sparging gas flow can be operated at a flow rate of between about 15 and about 20 standard cubic feet per minute (SCFM) for the duration of coalescence, and total sparge time can be from about 2 to about 6 hours, depending on completion of coalescence and removal of VOC's. Foam in the reactor headspace is directed to the separate tank filled with an anti-foam compound. Vapors from the reactor and the foam collection tank are allowed to condense and the condensate collected for disposal. The volatile vapors and foam from the reactor are removed from and are not returned to the reactor.

The particles can be permitted to aggregate until a predetermined desired particle size is obtained. Particle size can be monitored using, for example, a COULTER COUNTER, for average particle size. Aggregation thus can proceed by maintaining the elevated temperature, or by slowly raising the temperature to, for example, about 100° C. (although the temperature can be higher), and holding the mixture at that temperature, while maintaining stirring, to provide the aggregated particles. Once the desired particle size is attained, the growth process is halted.

To stop particle growth, pH of the slurry can be adjusted with a base to a value, for example, from about 4 to about 10, although a pH outside of that range can be used. The base or buffer used can include an alkali metal hydroxide, including sodium hydroxide and potassium hydroxide, ammonium hydroxide, combinations thereof and the like. In embodiments, a pH regulating compound, such as, ethylene diamine tetraacetic acid (EDTA) can be added to help adjust the pH to the desired value noted above.

Shell Formation

A shell can be applied to the formed aggregates or nascent toner particles. Any resin described herein can be used as the shell resin. The shell resin can be applied to the aggregated particles by any method. For example, the shell resin can be in an emulsion, with a surfactant. In embodiments, an amorphous resin can be used to form a shell to form core-shell toner particles. In embodiments, the shell comprises the same amorphous resin or resins found in the core.

The shell can comprise a colorant. A colorant is present in the shell in any desired or effective amount, in embodiments, at least about 0.5 percent by weight of the shell, in embodiments, at least about 1 percent by weight of the shell, in embodiments, no more than about 15 percent by weight of the shell, although the amount can be outside of those ranges.

In embodiments, the shell and the core comprise the same colorant. In embodiments, the shell comprises a first colorant and the core comprises a second colorant which is different from the first colorant.

Coalescence

Following aggregation to the desired particle size, with formation of an optional shell as described above, the particles then are coalesced to the desired final shape, the coalescence being achieved by, for example, heating the mixture to any desired or effective temperature, in embodiments at least about 85° C., in embodiments, at least about 90° C., in embodiments, no more than about 100° C., in embodiments, no more than about 95° C. although temperatures outside of those ranges can be used, which can be below the melting point of the resin(s) to prevent plasticization, so long as the particles are finished and sufficient VOC's are removed.

As described herein, gas flow into the slurry of particles in the reactor ensues during coalescence. Gas flow can commence at any time, such as, when the mixture temperature reaches about 65° C., about 70° C., about 75° C. or higher or lower than those ranges. The gas can be heated to a temperature not higher than the slurry temperature when the gas is introduced. The gas temperature can be held at that temperature and need not be increased to parallel the temperature of the slurry.

Coalescence proceeds over an effective period of time, in embodiments, at least about 2 hours, in embodiments, at least 3 hours, in embodiments, at least about 4 hours, in embodiments, at least about 5 hours, in embodiments, at least about 6 hours, although the period can vary depending on the degree of coalescence achieved and the amount of VOC's removed.

After coalescence, the mixture can be cooled to room temperature (RT) typically, from about 20° C. to about 25° C. The cooling can be rapid or slow. A suitable cooling method can include introducing cold water to a jacket around the reactor. After cooling, the toner particles optionally are washed with water and then dried, for example, by freeze drying.

In embodiments, the TVOC may be reduced by about 50%, about 55%, about 60%, about 65%, about 70%, about 75%, about 80% or more as compared to an analogous toner made with the same materials and by the same method but without the sparging of interest during coalescence.

Optional Additives

The toner particles can contain other optional additives. For example, the toner can include positive or negative charge control agents in any desired or effective amount, in embodiments, in an amount of at least about 0.1 percent by weight of the toner, in embodiments, at least about 1 percent by weight of the toner, in embodiments, no more than about 10 percent by weight of the toner, in embodiments, no more than about 3 percent by weight of the toner, although an amount outside of those ranges can be used. Examples of charge control agents include, but are not limited to, quaternary ammonium compounds inclusive of alkyl pyridinium halides; bisulfates; alkyl pyridinium compounds, including those disclosed in U.S. Pat. No. 4,298,672, the entire disclosure of which is incorporated herein by reference; organic sulfate and sulfonate compositions, including those disclosed in U.S. Pat. No. 4,338,390, the entire disclosure of which is incorporated herein by reference; cetyl pyridinium tetrafluoroborates; distearyl dimethyl ammonium methyl sulfate; aluminum salts, such as, BONTRON E84™ or E88™ (Hodogaya Chemical); and the like, as well as mixtures thereof. Such charge control agents can be applied simultaneously with the shell resin described above or after application of the shell.

There also can be blended with the toner particles, external additive particles, including flow aid additives, which can be present on the surfaces of the toner particles. Examples of those additives include, but are not limited to, metal oxides, such as, titanium oxide, silicon oxide, tin oxide and the like, as well as mixtures thereof, colloidal and amorphous silicas, such as, AEROSIL®, metal salts and metal salts of fatty acids including zinc stearate, aluminum oxides, cerium oxides and the like, as well as mixtures thereof. Each of those external additives can be present in any desired or effective amount, in embodiments, at least about 0.1% by weight of the toner, in embodiments, at least about 0.25 percent by weight of the toner, in embodiments, no more than about 5 percent by weight of the toner, although amounts outside those ranges can be used.

The toner particles can be formulated into a developer composition. The toner particles can be mixed with carrier particles to achieve a two-component developer composition. The carrier can comprise a resin coating. The toner concentration in the developer can be, in embodiments, at least about 1%, in embodiments, at least about 2%, in embodiments, no more than about 25% by weight, although amounts outside those ranges can be used.

The toner particles can have a circularity of at least about 0.92, in embodiments, at least about 0.94, in embodiments, at least about 0.96, although the value can be outside of those ranges. Circularity can be measured with, for example, a Sysmex FPIA 2100 analyzer.

Emulsion aggregation processes provide greater control over toner particle sizes and can limit the amount of both fine and coarse toner particles in the toner. The toner particles can have a relatively narrow particle size distribution with a number ratio geometric standard deviation ($GSD_n$) of at least about 1.15, at least about 1.18, at least about 1.20, although the value can be outside of those ranges. The toner particles can have a volume average diameter, (also referred to as "volume average particle diameter" or "$D_{50v}$,") of at least about 3 μm, at least about 4 μm, at least about 5 μm, although the value can be outside of those ranges. $D_{50v}$, $GSD_v$ and $GSD_n$ can be determined using a measuring instrument such as a BECKMAN COULTER MULTISIZER 3, operated in accordance with the manufacturer instructions.

The characteristics of the toner particles may be determined by any suitable technique and apparatus as known in the art and are not limited to the instruments and techniques indicated herein.

The toner of interest can be used in an imaging device as known in the art. Toner can be presented in a number of colorants, including clear, black, cyan, magenta, yellow, green, orange and so on.

Embodiments now will be described in the following Examples, which are intended to be illustrative and not limiting of the scope of the present disclosure. All parts and percentages are by weight unless otherwise indicated. RT refers to a temperature of from about 20° C. to about 25° C.

EXAMPLES

Example 1

5000-Liter Standard Process Black Toner

A 6000 gallon reactor was charged with 7577 kg of deionized water (DIW), 3951 kg of a styrene acrylate latex (average molecular weight of 37,000, a $T_g$ of around 59° C., a particle size of around 190 nm and solids content of about 41% (Latex A)), 177 kg of a cyan pigment dispersion containing surfactant (PB15:3 with solids content of 17.0%) and 872 kg of a carbon black pigment dispersion containing surfactant with solids content of 17.0%. The suspension is homogenized for 2 minutes before 744 kg of a paraffin wax dispersion containing surfactant with a $T_m$ of about 75.5° C. and 30.5% solids content are added. The suspension was homogenized for an additional 5 minutes and then 442 kg of a polyaluminum chloride (PAC) flocculent solution (44.25 kg PAC, 371 kg of DIW and 27 kg of 0.3M nitric acid) are added to the solution. Homogenization is continued for 90 minutes. Then, the slurry is aggregated to a particle size of 5.44 μm at a temperature of 57.5° C. Then, 1908 kg of Latex A are added to form a shell around the core particle. Final particle size is about 6.42 μm. After a 20 minute hold, around 392 kg of a 1 M NaOH solution are added to the reactor to increase the pH to 5.24. Next, the reactor is ramped to 90° C., at which point 29 kg of a 0.3 M nitric acid solution are added to lower the pH to 4.6. Then, the slurry is heated to 92° C. and held at that temperature until circularity reaches 0.977. At that point, the slurry is cooled to 53° C. and the pH is adjusted to 7.6 by adding 113 kg of NaOH. Finally, the batch is cooled to below 25° C.

The particle had a TVOC level of 410 μg/g, well above the targeted level of less than 300 μg/g.

Example 2

5000-Liter Sparging Process Black Toner

The materials and method of Example 1 were practiced up through the temperature ramp up to coalescence, that is, up to an including freezing of particle size growth. The reactor was modified to include an outlet port to course vapor and foam from the headspace of the reactor to a separate dedicated vessel containing an anti-foam reagent. Vapors in the separate dedicated vessel to retain form were course therefrom to a condenser. Condensate was returned to the foam-containing vessel.

When the reactor reached a temperature of 70° C., sparging air begins to bubble through the slurry at a rate of 18 SCFM. Excess foam passes into the foam suppression tank and is broken up by PDMS anti-foam compound contained in the tank. At 90° C., 29 kg of a 0.3 M nitric acid solution are added to allow for longer coalescence and sparging time. Then, the slurry is heated to 96° C. and held at that temperature until circularity reaches 0.976. At that point, the sparging air flow is discontinued and the slurry is cooled to 53° C. At 53° C., the pH is adjusted to 7.67 by adding 96 kg of a 1 M NaOH solution. Finally, the batch is cooled to below 25° C.

A total of 992 kg of material were removed from the reactor and contained in the foam tank during the sparging process. The removed material is enriched in VOC's removed from the slurry.

The final dry toner comprised a TVOC level of 197 μg/g, a 52% reduction from the VOC level of the toner of Example 1.

Table 1 presents certification results for the nominal EA process toner of Example 1 and the toner arising from the sparging process as described in Example 2. Compounds of interest are noted in boldface.

Percent removal of VOC's from the black toner was 76.9% and percent removal of VOC's from a mixture of CMY toners was 75%.

TABLE 1

Analysis of toner of standard and sparging processes.

| | Black (mg/kg) | | CMY Mix (mg/kg) | |
|---|---|---|---|---|
| Compound | Standard | Sparged | Standard | Sparged |
| Benzene | <0.3 | <0.3 | <0.3 | <0.3 |
| Toluene | 0.4 | ND | 0.3 | ND |
| **Ethylbenzene** | **9.2** | **3.3** | **9.4** | **2.3** |
| m-Xylene | 0.4 | ND | 0.3 | ND |
| o-Xylene | 2.9 | 1.0 | 2.4 | 0.8 |
| **Isopropylbenzene** | **63** | **18** | **48** | **15** |
| **n-Propylbenzene** | **36** | **9.6** | **29** | **8.2** |
| 2-ethyltoluene | 1.2 | 0.6 | 1.5 | 0.6 |
| 3-ethyltoluene | 8.0 | 2.8 | 7.7 | 2.5 |
| 4-ethyltoluene | 5.6 | 2.0 | 5.1 | 1.7 |
| **Styrene** | **9.4** | **2.2** | **8.3** | **3.1** |
| n-Decane | 0.7 | 0.3 | 1.5 | 0.3 |
| n-Undecane | 0.3 | ND | 0.3 | ND |
| n-Dodecane | 3.1 | 1.6 | 2.6 | 1.2 |
| n-Tetradecane | 0.6 | ND | 0.4 | ND |
| Limonene | <0.3 | ND | 2.5 | 0.5 |
| n-Butanol | 2.8 | 0.6 | 2.6 | 0.5 |
| n-Nonanol | 0.4 | ND | 0.3 | ND |
| n-Decanol | 0.8 | ND | <0.3 | ND |
| Trimethylsilanol | ND | 0.8 | ND | 0.7 |
| n-Butyl acetate | 10 | 1.2 | 10 | 0.9 |
| Hexamethyldisiloxane | 1.4 | 0.8 | 0.8 | ND |
| Acetic acid | 0.7 | 0.4 | 0.4 | 0.3 |
| Hexamethylcyclotrisiloxane | 1.3 | ND | 0.6 | ND |
| Octamethyltrisiloxane | 0.5 | ND | 0.3 | ND |
| **n-Butyl ether** | **94** | **20** | **84** | **13** |
| Octamethylcyclotetrasiloxane | 4.8 | 2.2 | 7.5 | 2.1 |
| 1-Phenylpropene | 12 | ND | 9.2 | ND |
| n-Butyl acrylate | 2.0 | 0.5 | 1.9 | 0.6 |

TABLE 1-continued

Analysis of toner of standard and sparging processes.

| Compound | Black (mg/kg) Standard | Black (mg/kg) Sparged | CMY Mix (mg/kg) Standard | CMY Mix (mg/kg) Sparged |
|---|---|---|---|---|
| **n-Butyl propionate** | **37** | **5.8** | **37** | **4.6** |
| Decamethyltetrasiloxane | 5.2 | ND | 9.2 | ND |
| Indane | <0.3 | ND | 0.6 | ND |
| n-Butyl butyrate | 1.7 | 1.0 | 1.6 | 0.9 |
| Decamethylcyclopenta-siloxane | 5.2 | 3.0 | 9.2 | 2.2 |
| **Benzaldehyde** | **66** | **0.5** | **68** | **19** |
| Dodecamethylpentasiloxane | 0.5 | ND | 0.5 | ND |
| Acetophenone | 2.2 | 1.2 | 1.9 | 1.5 |
| Dodecamethylcyclohexa-siloxane | 4.3 | 3.4 | 4.1 | 2.3 |
| Tetradecamethylhexasiloxane | 0.5 | ND | 0.3 | ND |
| Tertadecamethylcyclohepta-siloxane | 2.1 | 0.9 | 1.4 | 0.6 |
| Not Identified Compounds | 63 | 22 | 50 | 19 |
| Total | 455.6 | 105.3 | 417.6 | 104.4 |

(ND = Not Detected)

Sparging of VOC's from the emulsion into the stripping air is a purely physical phenomenon. The method does not interfere with coalescence of the toner particles, nor does sparging damage the structural integrity of the particle. All primary properties of the dry particle that are related to structural integrity (for example, particle size distribution and shape) for toner produced using the sparging process were within product specifications (Table 2).

TABLE 2

Particle properties of sparged and standard toner particles.

| Property | Black Standard | Black Sparged | Cyan Sparged | Yellow Sparged | Magenta Sparged |
|---|---|---|---|---|---|
| Volume Median (μm) | 5.90-6.70 | 6.29 | 6.19 | 6.37 | 6.28 |
| GSD 50/16n | <1.250 | 1.222 | 1.198 | 1.211 | 1.211 |
| GSD 84/50v | <1.230 | 1.187 | 1.194 | 1.191 | 1.183 |

TABLE 2-continued

Particle properties of sparged and standard toner particles.

| Property | Black Standard | Black Sparged | Cyan Sparged | Yellow Sparged | Magenta Sparged |
|---|---|---|---|---|---|
| Fines (number) 1.4-4.0 μm (%) | <3.00 | 1.44 | 1.62 | 1.25 | 1.08 |
| Coarse (volume) 12.7-42.0 μm (%) | <1.00 | 0.05 | 0.08 | 0.00 | 0.00 |
| Circularity | 0.969-0.983 | 0.976 | 0.974 | 0.970 | 0.973 |

The sparging process results in a particle that has similar supplemental properties to those produced using the standard process, with the following exceptions: 1) removal of foam that comprises surfactant leads to reduced levels of surfactant(s), for example, alkyldiphenyloxide disulfonate and sodium dodecylbenzene sulfonate, in the dry particle; 2) particles generated using the sparging process have a lower melt flow index (MFI) than particles generated using the standard process; and 3) particles had lower VOC content. Table 3 presents a comparison of supplemental properties. BET is the Brunauer-Emmett-Teller method for determining surface area. ICP-MS is inductively coupled plasma mass spectrometry. DSC is differential scanning calorimetry. XRPS is X-ray photoelectron spectroscopy.

TABLE 3

Supplemental properties of standard and sparging process toners.

| Property | Measurement Method | Black Standard | Cyan Standard | Black Sparged | Cyan Sparged |
|---|---|---|---|---|---|
| Specific Surface Area ($m^2/g$) | Multi Point BET Method | 1.30 | 1.26 | 1.28 | 1.28 |
| Alkyldiphenyloxide Disulfonate (μg/g) | ICP-MS | 168 | 219 | 159 | 161 |
| Sodium Dodecyl Benzenesulfonate (μg/g) | ICP-MS | 1745 | 1935 | 1620 | 1401 |
| Melt Flow Index (g/10 min) | ASTM D 1238-10 Proc-B (130° C., 5 kg) | 29.1 | 26.8 | 23.3 | 20.7 |
| Tg Onset (° C.) | DSC | 53.4 | 54.2 | 53.0 | 50.1 |
| Tg Midpoint (° C.) | DSC | 58.6 | 58.2 | 57.7 | 55.6 |
| Surface O (%) | XRPS | 10.49 | 10.59 | 10.43 | 10.71 |
| Surface Al (%) | XRPS | 0.25 | 0.30 | 0.27 | 0.35 |
| Surface Na (%) | XRPS | 0 | 0 | 0 | 0 |
| Surface S (%) | XRPS | 0.25 | 0.27 | 0.30 | 0.35 |
| Surface Wax (%) | XRPS | 2 | 1 | 1 | 2 |
| Bulk Al (μg/g) | ICP-MS | | 892 | | 873 |
| Bulk Ca (μg/g) | ICP-MS | | 4 | | 10 |
| Bulk Cu (μg/g) | ICP-MS | | 4910 | | 4960 |
| Bulk Na (μg/g) | ICP-MS | | 200 | | 240 |

The experimental toners were hand packed into cartridges and 12,000 prints were generated within a controlled environment of 70° F. and 10% relative humidity. The prints were evaluated for solid area density, color, cleaning defect level, mottle level, toner/additive build-up level, background level, print yield and toner consumption rate.

The experimental toners produced by sparging were found to perform equivalently to manufactured toners made without sparging.

It will be appreciated that several of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are herein incorporated by reference in entirety.

We claim:

1. A method for reducing volatile organic compounds (VOCs) in emulsion aggregation (EA) toner particles, the method comprising:

(a) homogenizing a slurry of one or more resins;

(b) aggregating the slurry to produce growing aggregate particles;

(c) optionally, forming a shell over the growing aggregate particles;

(d) stopping the growth of aggregate particles by increasing the pH of the slurry;

(e) increasing the temperature of the slurry to induce coalescence of the growth-stopped aggregate particles;

(f) during step (e), sparging a gas through the slurry to remove VOCs from the coalescing aggregate particles;

(g) cooling the slurry, wherein the cooled slurry comprises aggregate particles that have coalesced to become EA toner particles; and (h) separating the EA toner particles from the slurry and drying the separated EA toner particles, wherein the dried EA toner particles are characterized by a total VOC (TVOC) content of less than about 350 ppm.

2. The method of claim 1, wherein the TVOC content of the dried EA toner particles is less than about 300 ppm.

3. The method of claim 1, wherein the sparging step (f) takes place when the temperature is in the range of from about 65° C. to about 75° C.

4. The method of claim 3, wherein the sparging step (f) takes place when the temperature is about 70° C.

5. The method of claim 1, wherein the gas of the sparging step (f) is air.

6. The method of claim 1, wherein the gas is sparged at a flow of at least 15 standard cubic feet per minute.

7. The method of claim 1, wherein the temperature is increased to a value in the range of from about 92° C. to about 96° C.

8. The method of claim 1, further comprising removing foam generated during the sparging step (f) from a reactor containing the slurry.

9. The method of claim 8, wherein separating comprises directing the foam to a foam treatment tank.

10. The method of claim 9, wherein the foam treatment tank comprises an anti-foaming agent.

11. The method of claim 1, wherein the one or more resins are selected from amorphous resins, crystalline resins and combinations thereof.

12. The method of claim 1, wherein the VOC's are selected from the group consisting of benzene, toluene, ethylbenzene, m-xylene, o-xylene, isopropylbenzene, n propylbenzene, 2-ethyltoluene, 3-ethyltoluene, 4-ethyltoluene, styrene, n-decane, n undecane, n-dodecane, n-tetradecane, limonene, n-butanol, n-nonanol, n-decanol, trimethylsilanol, n-butyl acetate, hexamethyldisiloxane, acetic acid, hexamethylcyclotrisiloxane, octamethyltrisiloxane, n-butyl ether, cctamethylcyclotetrasiloxane, 1-phenylpropene, n-butyl acrylate, n-butyl propionate, decamethyltetrasiloxane, indane, n-butyl butyrate, decamethylcyclopentasiloxane, benzaldehyde, dodecamethylpentasiloxane, acetophenone, dodecamethylcyclohexasiloxane, tetradecamethylhexasiloxane, tertadecamethylcycloheptasiloxane and combinations thereof.

13. The method of claim 1, wherein the gas of the sparging step (f) is air and the method further comprises removing foam generated during the sparging step (f) from a reactor containing the slurry.

14. The method of claim 13, wherein the sparging step (f) takes place when the temperature is in the range of from about 65° C. to about 75° C.

15. The method of claim 14, wherein the temperature is increased to a value in the range of from about 92° C. to about 96° C.

16. The method of claim 15, wherein the gas is sparged at a flow of at least 15 standard cubic feet per minute.

17. The method of claim 13, wherein separating comprises directing the foam to a foam treatment tank comprising an anti-foaming agent.

18. A method for reducing volatile organic compounds (VOCs) in emulsion aggregation (EA) toner particles, the method comprising:

(a) homogenizing a slurry of one or more resins;

(b) aggregating the slurry to produce growing aggregate particles;

(c) optionally, forming a shell over the growing aggregate particles;

(d) stopping the growth of aggregate particles by increasing the pH of the slurry;

(e) increasing the temperature of the slurry to induce coalescence of the growth-stopped aggregate particles;

(f) during step (e), sparging a gas through the slurry to remove VOCs from the coalescing aggregate particles;

(g) cooling the slurry, wherein the cooled slurry comprises aggregate particles that have coalesced to become EA toner particles; and (f) separating the EA toner particles from the slurry and drying the separated EA toner particles, wherein the dried EA toner particles are characterized by a total VOC (TVOC) content which is at least about 50% lower as compared to the same method having the same steps except for the sparging step (f).

19. The method of claim 18, wherein the TVOC content is at least about 70% lower.

* * * * *